US007967601B2

(12) United States Patent
Johnston et al.

(10) Patent No.: US 7,967,601 B2
(45) Date of Patent: Jun. 28, 2011

(54) SAFETY MECHANISM FOR A TORCH

(75) Inventors: Michael R Johnston, Troutman, NC (US); Thomas A. Burdsall, Huntersville, NC (US)

(73) Assignee: Irwin Industrial Tool Company, Huntersville, NC (US)

( * ) Notice: Subject to any disclaimer, the term of this patent is extended or adjusted under 35 U.S.C. 154(b) by 1200 days.

(21) Appl. No.: 11/612,746

(22) Filed: Dec. 19, 2006

(65) Prior Publication Data

US 2007/0281263 A1 Dec. 6, 2007

Related U.S. Application Data

(60) Provisional application No. 60/809,373, filed on May 30, 2006.

(51) Int. Cl.
*F23Q 2/28* (2006.01)
*F23D 11/36* (2006.01)

(52) U.S. Cl. ..... 431/255; 431/153; 431/254; 200/506; 361/126; 218/51; 218/91; 218/118

(58) Field of Classification Search ..... 431/153, 431/255, 344, 254; 200/506; 361/126
See application file for complete search history.

(56) References Cited

U.S. PATENT DOCUMENTS

| | | | | |
|---|---|---|---|---|
| 2,068,422 | A | 1/1937 | Lotz | |
| 2,206,709 | A | 7/1940 | Suits | |
| 2,477,837 | A * | 8/1949 | Strom | 218/91 |
| 3,247,423 | A | 4/1966 | Nolta et al. | |
| 3,588,302 | A | 6/1971 | Herlan | |
| 3,829,739 | A | 8/1974 | Andersen et al. | |
| 4,011,426 | A | 3/1977 | Lange | |
| 4,220,443 | A | 9/1980 | Bear | |
| 4,473,859 | A | 9/1984 | Stone et al. | |
| 4,620,122 | A * | 10/1986 | Howell | 310/328 |
| 4,717,796 | A | 1/1988 | Howell | |

(Continued)

FOREIGN PATENT DOCUMENTS

GB 2404723 2/2005

(Continued)

OTHER PUBLICATIONS

UK Search Report dated Sep. 4, 2007.

(Continued)

*Primary Examiner* — Steven B. McAllister
*Assistant Examiner* — Nikhil Mashruwala
(74) *Attorney, Agent, or Firm* — Dennis J. Williamson; Moore & Van Allen, PLLC

(57) ABSTRACT

A device for creating an electrical potential, such as a piezoelectric igniter, is connected to a conductor that conducts current to a burn tube to create a spark that ignites the fuel in the burn tube. In one embodiment a gap is formed in the conductor. An insulator is located in the gap such that is can be selectively moved between an insulating position where the flow of electricity over the gap is prevented such that no spark is created in the burn tube and a non-insulating position where electricity is allowed to flow over the gap such that a spark is created in the burn tube. In another embodiment the piezoelectric igniter forms part of the electrical circuit and is in electrical conductive contact or proximity to an electrical conductor that forms part of the ignition circuit. An insulator may selectively located between the igniter and the conductor.

7 Claims, 11 Drawing Sheets

U.S. PATENT DOCUMENTS

| | | | | | |
|---|---|---|---|---|---|
| 4,832,596 | A | | 5/1989 | Morris, Sr. | |
| 4,904,180 | A | | 2/1990 | Nitta | |
| 5,326,256 | A | | 7/1994 | Shike et al. | |
| 5,496,169 | A | | 3/1996 | Chen | |
| 5,655,901 | A | | 8/1997 | Makoto | |
| 5,697,775 | A | | 12/1997 | Saito et al. | |
| 5,743,724 | A | | 4/1998 | Mifune et al. | |
| 5,771,880 | A | * | 6/1998 | Tsai | 126/414 |
| 5,897,308 | A | | 4/1999 | Saito et al. | |
| 5,975,888 | A | | 11/1999 | Hsu | |
| 6,042,367 | A | | 3/2000 | Saito et al. | |
| 6,065,958 | A | * | 5/2000 | Adams et al. | 431/153 |
| 6,093,017 | A | | 7/2000 | Saito et al. | |
| 6,168,420 | B1 | | 1/2001 | Sung | |
| 6,186,773 | B1 | | 2/2001 | Sung | |
| 6,241,511 | B1 | | 6/2001 | Hsu | |
| 6,315,550 | B1 | | 11/2001 | Sher | |
| 6,336,807 | B1 | | 1/2002 | Hsu | |
| 6,439,879 | B1 | | 8/2002 | Hsu | |
| 6,565,354 | B2 | | 5/2003 | Liang | |
| 6,682,340 | B2 | | 1/2004 | Kim | |
| 6,692,248 | B2 | | 2/2004 | Huang et al. | |
| 6,722,877 | B2 | | 4/2004 | Wang et al. | |
| 6,765,338 | B2 | * | 7/2004 | Orazietti | 310/339 |
| 6,867,955 | B2 | | 3/2005 | Chou et al. | |
| 6,940,234 | B2 | | 9/2005 | Chou et al. | |
| 6,997,700 | B2 | | 2/2006 | Kim | |
| 7,771,191 | B2 | * | 8/2010 | Johnston et al. | 431/153 |
| 2003/0022120 | A1 | * | 1/2003 | Liang | 431/255 |
| 2003/0124476 | A1 | | 7/2003 | Chung Yang | |

FOREIGN PATENT DOCUMENTS

| | | | |
|---|---|---|---|
| GB | 2416023 | | 1/2006 |
| SU | 983853 | * | 12/1982 |
| TW | 329908 | | 4/1998 |
| TW | 552376 | | 9/2003 |
| WO | 9208931 | | 5/1992 |
| WO | 9208931 | A1 | 5/1992 |
| WO | 0052390 | | 9/2000 |

OTHER PUBLICATIONS

Search Report, UK Patent Application No. 0708273.8, dated Dec. 29, 2007.

German Patent Office, Office Action, Jun. 5, 2009.

ROC (Taiwan) Intellectual Property Office, Office Action on Taiwan Patent Application No. 096114093, Mar. 4, 2011.

* cited by examiner

SAFETY MECHANISM FOR A TORCH

This application claims the benefit of priority under 35 U.S.C. §119(e) to the filing date of U.S. Provisional Application 60/809,373 filed on May 30, 2006, which is incorporated herein by reference in its entirety.

The invention relates to self-igniting torches and lighters such as propane, butane, mixed gas or MAPP fueled torches and butane lighters that use a source of fuel that is ignited by a spark generated by, for example, a piezoelectric igniter (collectively "torch"). Such torches are used for heating, brazing, welding and the like and such lighters are commonly used in household applications for lighting fireplaces, grills and the like.

BACKGROUND OF THE INVENTION

Self-igniting torches and lighters typically include a trigger or push button ignition that when depressed, releases a flow of fuel gas under pressure into a burn tube and simultaneously activates the igniter to create a spark that ignites the fuel in the burn tube. The ignited fuel creates a steady flame at the end of the burn tube that can be used in a variety of heating/lighting applications. Safety standards for lighters to prevent the unsafe ignition of these devices such as by a child are set forth in 16 C.F.R. §1212. To comply with the safety standards various solutions have been developed to prevent the inadvertent or unsafe lighting of the torch.

SUMMARY OF THE INVENTION

The present invention provides alternative mechanisms for preventing the unsafe operation of a torch or lighter that interrupts the flow of electricity from the igniter to the burn tube to thereby prevent ignition of the fuel by the igniter using the trigger. A device for creating an electrical potential, such as a piezoelectric igniter, is connected to a conductor that conducts current to a burn tube to create a spark that ignites the fuel in the burn tube. In one embodiment a gap is formed in the conductor. An insulator may be located in the gap such that it can be selectively moved between an insulating position where the flow of electricity over the gap is prevented and no spark is created in the burn tube and a non-insulating position where current flows over the gap such that a spark is created in the burn tube. In another embodiment the piezoelectric igniter forms part of the electrical circuit and is in electrical conductive contact or proximity to an electrical conductor that forms part of the ignition circuit. In one embodiment the electrical conductor may be part of the fuel supply system. An insulator may be selectively located between the igniter and the conductor such that it can be moved between an insulating position where the flow of current between the igniter and conductor is prevented and no spark is created in the burn tube and a non-insulating position where current flows between the igniter and conductor such that a spark is created in the burn tube.

DETAILED DESCRIPTION OF EMBODIMENTS OF THE INVENTION

A typical torch or lighter consists of a fuel source such as butane, propane, mixed gas, MAPP gas or other fuel held under pressure in a fuel container. In a torch the fuel container may be a tank or canister releasably connected to the torch body such that the fuel supply can be removed when empty and replaced. In a lighter the fuel container may be a relatively small plastic receptacle that is formed as an integral part of the lighter such that the lighter may be either refilled or disposed of when the fuel supply is empty. The fuel supply is connected to a fuel supply system that transports the fuel to a burn tube where it is ignited. In a torch the fuel container, fuel supply system (such as regulator and control valves) and burn tube may comprise separate components that are connected together such that the fuel containers may be removed and replaced and different burn tubes for different applications may be used. In simpler and less expensive lighters the fuel supply, burn tube and fuel supply system may form part of a single device that may be intended to be disposed of after the fuel is depleted. The safety mechanism of the invention has application in either type of system. As used herein the term torch is intended to refer to both types of lighting devices.

Figure 1:
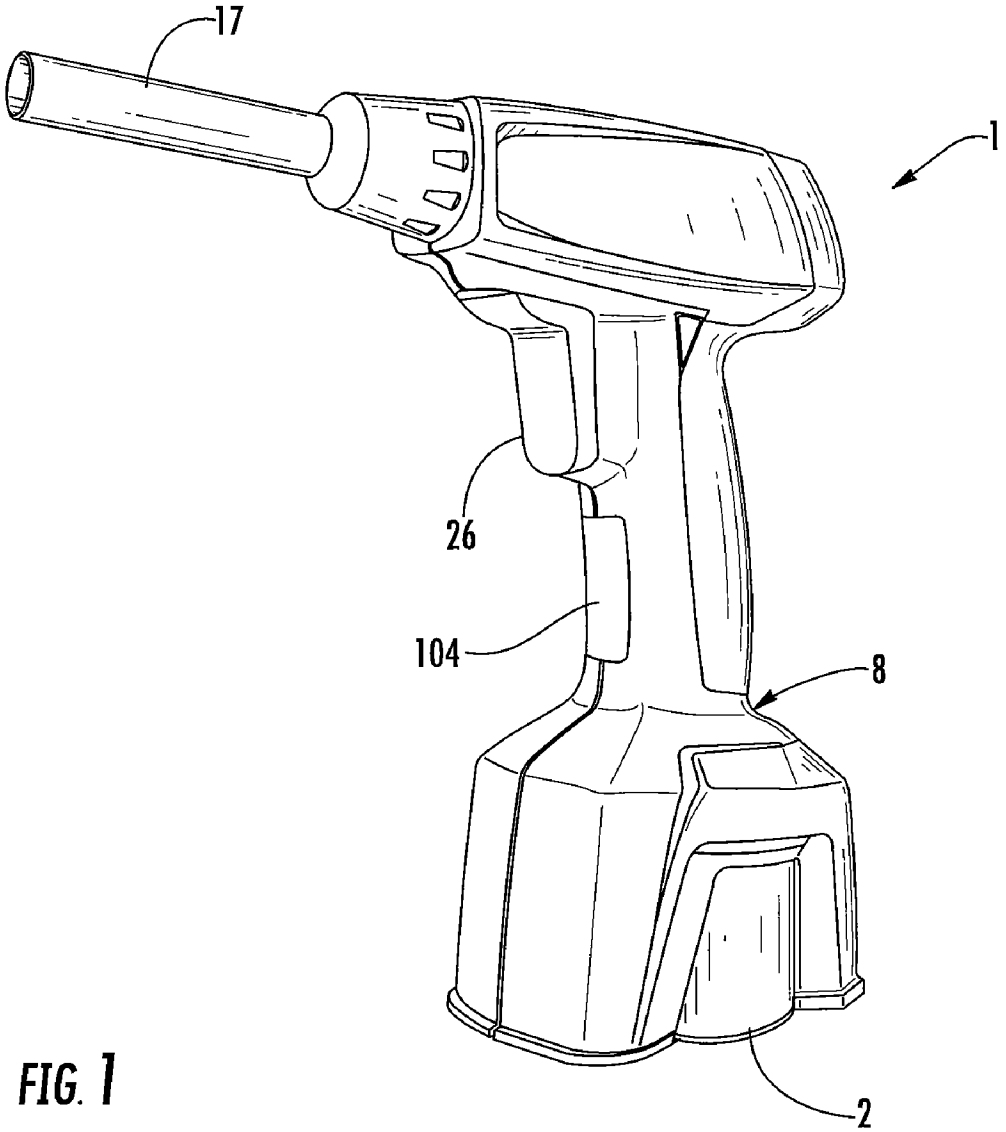
FIG. 1 is a perspective view of one embodiment of a torch that uses the safety mechanism of the invention.
Figure 2:
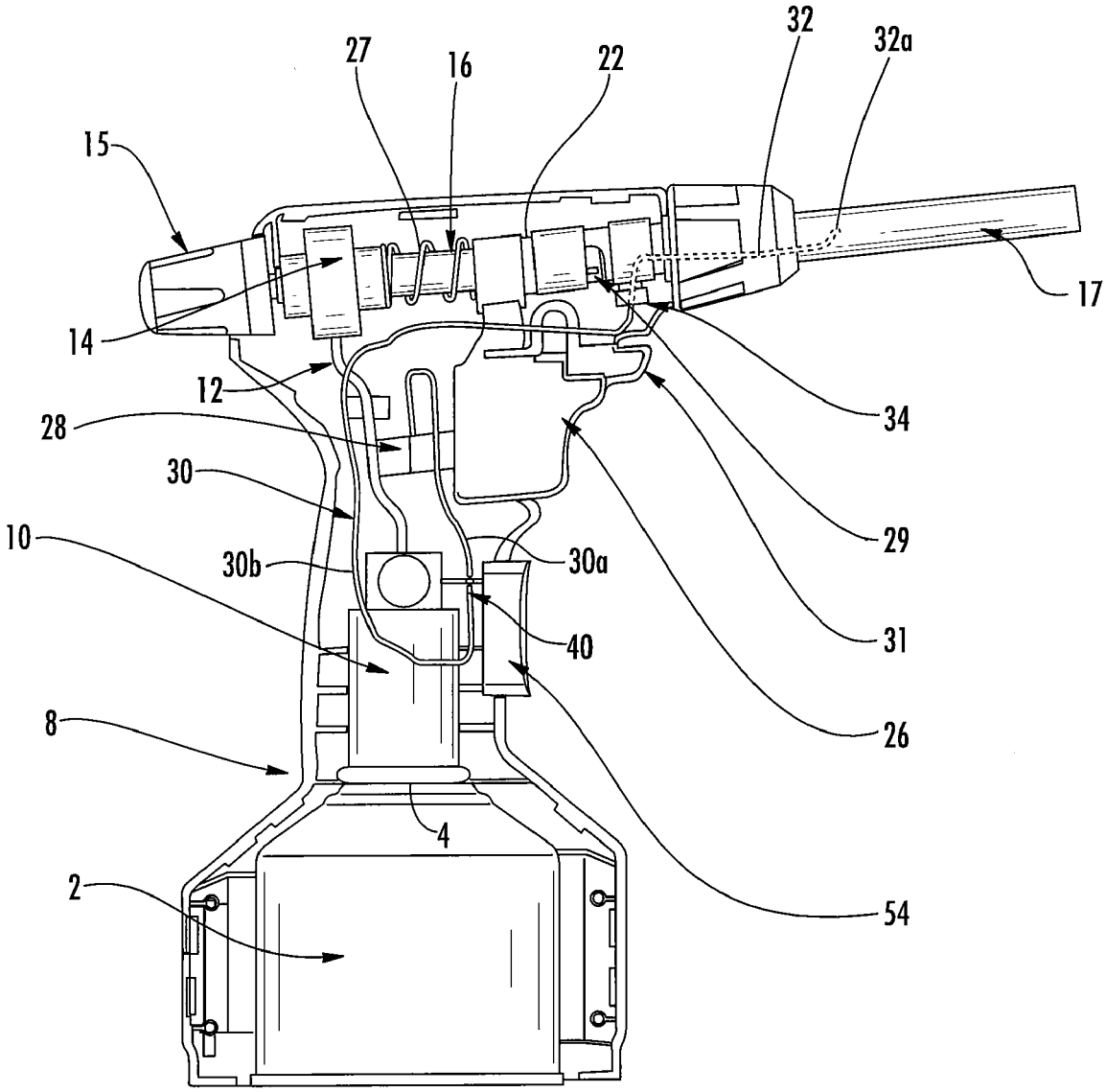
FIG. 2 is a side view of one embodiment of a torch of the invention with a portion of the torch body removed to show the internal components of the torch.
Figure 9:
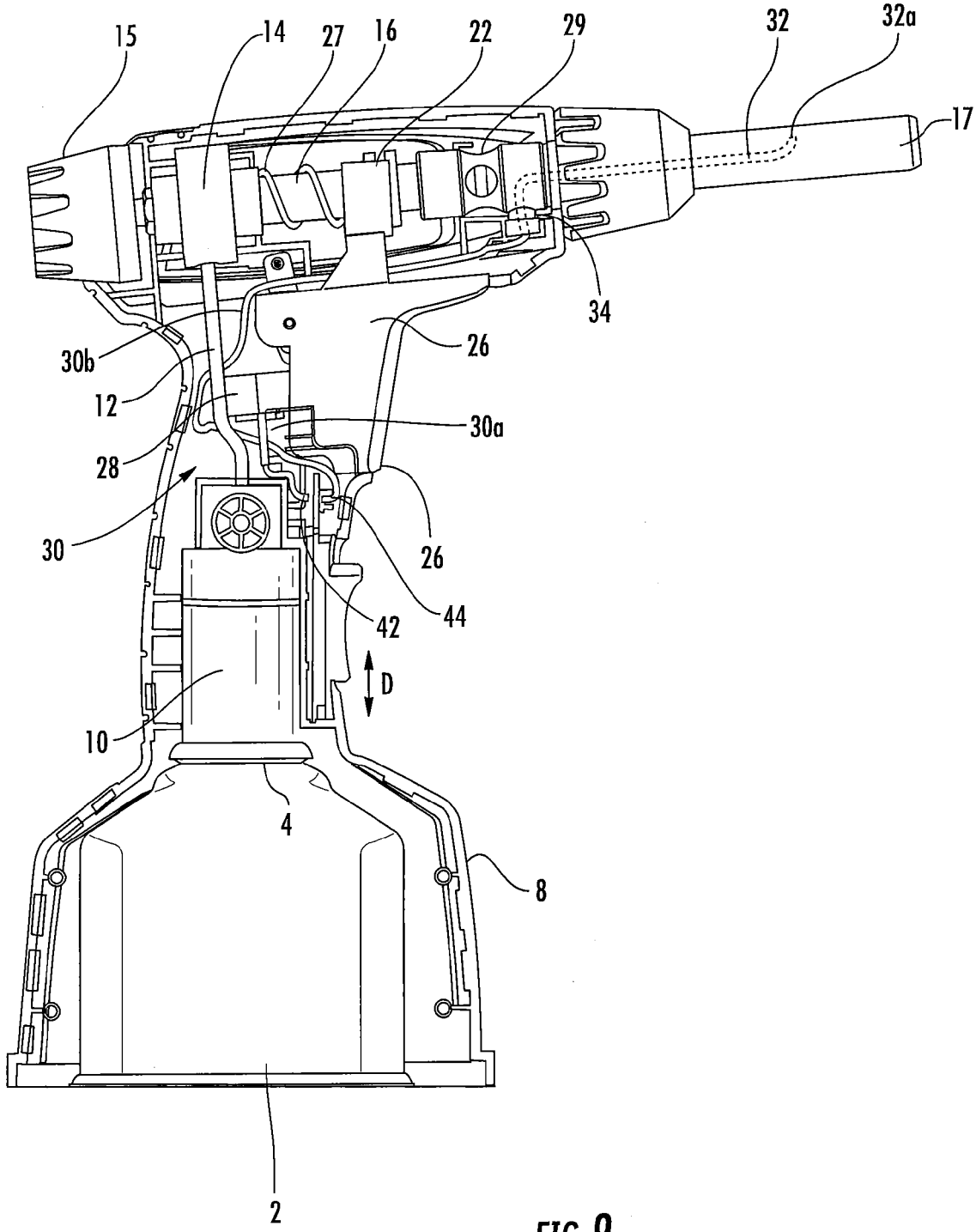
FIG. 9 is a side view of another embodiment of a torch of the invention with a portion of the torch body removed to show the internal components of the torch.

An example embodiment of a torch 1 employing the safety mechanisms of the invention are shown in the FIGS. 1, 2 and 9 and consist of a canister 2 for holding a supply of fuel. The canister 2 may be formed with screw threads or other releasable connector adjacent the canister's inlet/outlet port 4 to connect the canister to the torch body or housing 8 and the fuel supply system.

The torch body 8 may contain each of the components of the fuel supply system in an integral unit or the components may be releasably secured to the torch body such that the components may be replaced. The typical fuel supply system for a torch may include a regulator 10 for regulating the flow of fuel from tank 2 such that the fuel enters the fuel supply system under a constant pressure; however, the regulator is not required for the torch. If a regulator is used the regulator 10 may include a spring loaded diaphragm or piston that provides a flow of fuel under a constant pressure to avoid pressure variations that may occur due to variations in temperature, elevation or the like. A fuel supply line 12 connects the regulator to a gas valve 14 such that the fuel flowing from regulator 10 is delivered to the input port of the gas valve 14. The output port of the gas valve 14 is connected to fuel supply line 16. Typically, a manually actuated flow control such as knob 15 is used to open or close the gas valve 14 and control the flow of fuel to the burn tube 17. By manipulating control 15, a user can control the size/heat of the flame generated by the torch. Valve 14 and control 15 may be eliminated if control of the flame size is not required. Fuel supply line 16 terminates in an orifice 18 (FIG. 3) that receives burn tube 17 such that gas exiting orifice 18 flows under pressure through the burn tube 17.

To release the fuel through orifice 18 and into burn tube 17 a valve 22 is located in gas supply line 16 that is actuated by a push button/trigger 26. When trigger 26 is depressed valve 22 is opened to allow the fuel to flow through Venturi 29 and into fuel supply line 16, out of orifice 18 and into burn tube 17. A spring 27 returns the valve to the closed position when the trigger is released. Trigger 26 also actuates piezoelectric igniter 28 when the trigger is depressed such that a spark is created in the burn tube 17 while gas is flowing through the burn tube. A trigger lock 31 (FIG. 2) may also be provided to mechanically lock the trigger in the depressed position to allow "hands-free" operation of the torch such that the torch will produce a flame without the user having to continually depress the trigger 26.

To create the spark, trigger 26 is mechanically connected to piezoelectric igniter 28 that is connected to an electrical conductor such as a wire 30. The electrical conductor may include any electrically conductive element. One end of piezoelectric igniter 28 may be in electrically conductive contact with the fuel supply line 12 in order to complete the electrical circuit. Due to the size of the charge used, the igniter 28 does not have to actually touch the fuel line because arcing can occur if a small gap exists between the igniter and the fuel supply line 12. Rather than using the fuel supply line 12 to complete the circuit, wires or other electrically conductive elements may be used to complete the circuit. Fuel supply line 12 is made of electrically conductive material such as copper, brass or the like. Wire 30 extends to the burn tube 17 where it mechanically engages an electrical conductor 32 that extends into burn tube 17. In the illustrated embodiment releasable connector 34 electrically connects conductor 30 to conductor 32 to create an electrical path between the piezoelectric igniter 28 and the inside of burn tube 17 to allow the burn tube to be removed from the valve body. Connector 34 may be omitted and a single electrical conductor may extend from the torch body and into the burn tube.

To create the spark in the burn tube 17, piezoelectric igniter 28 is actuated by depressing trigger 26. The end 32*a* of electrical conductor 32 is positioned in burn tube 17 such that it is spaced from the burn tube a distance such that arcing occurs between the end of the conductor 32*a* and the interior surface of burn tube 17 to create a spark that ignites the fuel/air mixture flowing through the burn tube.

As best shown in FIGS. 3, 4, 9 and 10, in one embodiment the safety device of the invention uses a gap 40 in the electrical conductor 30 located within the body 8 where the gap 40 is isolated from the fuel. Gap 40 is created by a first conductor portion 30*a* that extends from piezoelectric igniter 28 to terminus 42 and a second conductor portion 30*b* that extends from terminus 44 to the burn tube. Termini 42 and 44 are spaced to create gap 40 that is sized such that arcing can occur between the termini 42 and 44 when an air gap is present between the termini. The arcing completes a circuit between first conductor portion 30*a* and second conductor portion 30*b* such that the electrical potential created by igniter 28 is transmitted to the burn tube 17. If an insulator is placed in gap 40 to electrically isolate the termini from one another no arcing occurs between the termini 42 and 44 and no current is delivered to the burn tube thereby preventing the ignition of fuel in the burn tube by pressing the trigger 26.

Figure 3:
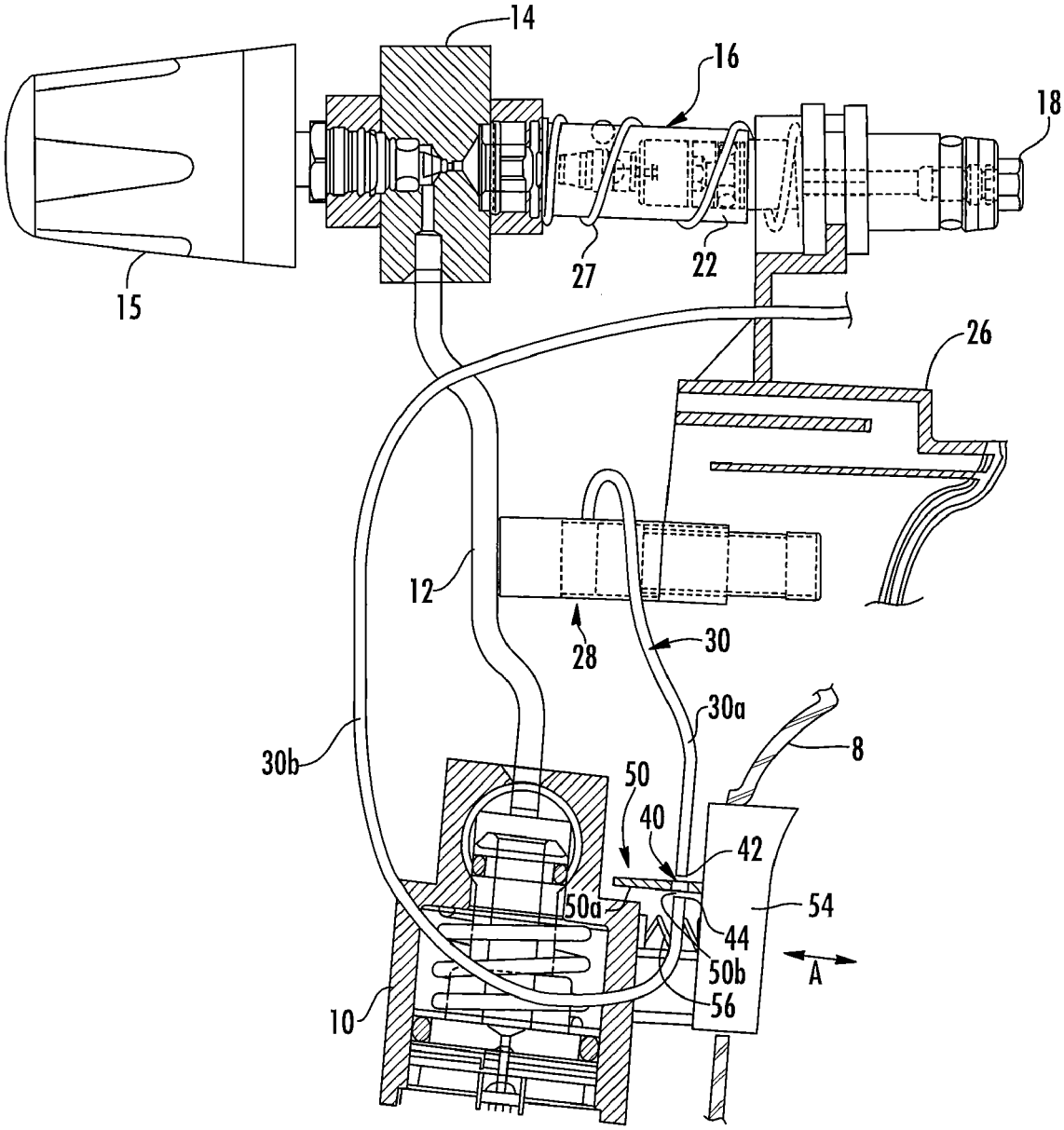
FIG. 3 is a view of the internal structure of one embodiment of a torch of the invention.

Referring to the embodiment shown in FIGS. 2 and 3, the insulator 50 consists of an electrically non-conductive member 50*a* that extends between the termini 42 and 44 to selectively prevent arcing therebetween. In a torch that uses an igniter that generates 15,000 volts, the insulator may comprise a non-conductive pad that is approximately $^{70}/_{1000}$ of an inch thick and approximately ¾ of an inch long and ⅝ of an inch wide. A pad of such dimensions prevents arcing from occurring either through or around the pad and electrically isolates the termini 42 and 44 from one another. Other dimensions for the insulator may also be used as dictated by the specific design of the system provided that the insulator prevents arcing in the safety or insulating position but allows arcing in the on or non-insulating position.

To allow arcing to occur for ignition, insulator 50 defines a through hole 50*b* that can be brought into proximity with the termini 42 and 44 such that arcing can occur between the termini through the hole 50*b*. To move the insulator and allow selective arcing to occur, the insulator 50 is fixed to a switch such as push button 54 located on the torch body 8 such that it is accessible by the user when holding the torch. In one embodiment the push button is located on the torch body such that it can be depressed by a user's fingers when the user depresses the trigger 26 with fingers of the same hand. The push button may be located in other positions where either one or two handed operation is possible.

The push button 54 can move relative to the torch body as represented by arrow A such that the insulator occupies a first position electrically isolating the termini 42 and 44 from one another and a second position where hole 52 is brought into proximity with termini 42 and 44 (shown in FIG. 3) such that arcing may occur between the termini. A compression spring 56 located between the push button 54 and the torch body biases the insulator 50 to the insulating or "safety" position such that the solid portion of insulator 50 is located between the termini 42 and 44 and arcing is prevented. To light the torch the push button 54 is depressed thereby bringing hole 52 of insulator 50 into proximity with the termini 42 and 44. Once button 54 is depressed, the trigger 26 can be depressed thereby releasing gas into the burn tube and actuating igniter 28. Current travels over conductor 30*a* until it reaches terminus 42 at which time arcing occurs between termini 42 and 44. Current then travels over conductor portion 30*b* to burn tube 17 to create an arc and ignite the fuel in the burn tube 17. The push button 54 can be released such that spring 56 moves insulator 50 back to the insulating "safety" position. Trigger 26 can remain depressed to maintain the flame for as long as desired. While insulator 50 is shown with a hole 52 that allows arcing between the termini 42 and 44, the insulator may be formed with a notch, a thinned web portion, multiple holes or the like that allow an arc to pass between conductors 30*a* and 30*b*. Moreover, the insulator may be moved completely out of gap 40 such that arcing occurs around the insulator rather than through the insulator.

When trigger 26 is released the flow of fuel stops due to the closing of valve 22. The torch can only be reignited by again depressing push button 54 and then trigger 26. If push button 54 is not depressed, trigger 26 can still be depressed, however, the torch will not self-ignite because no arcing occurs between termini 42 and 44 and no electrical current flows to the burn tube 17.

Figure 10:
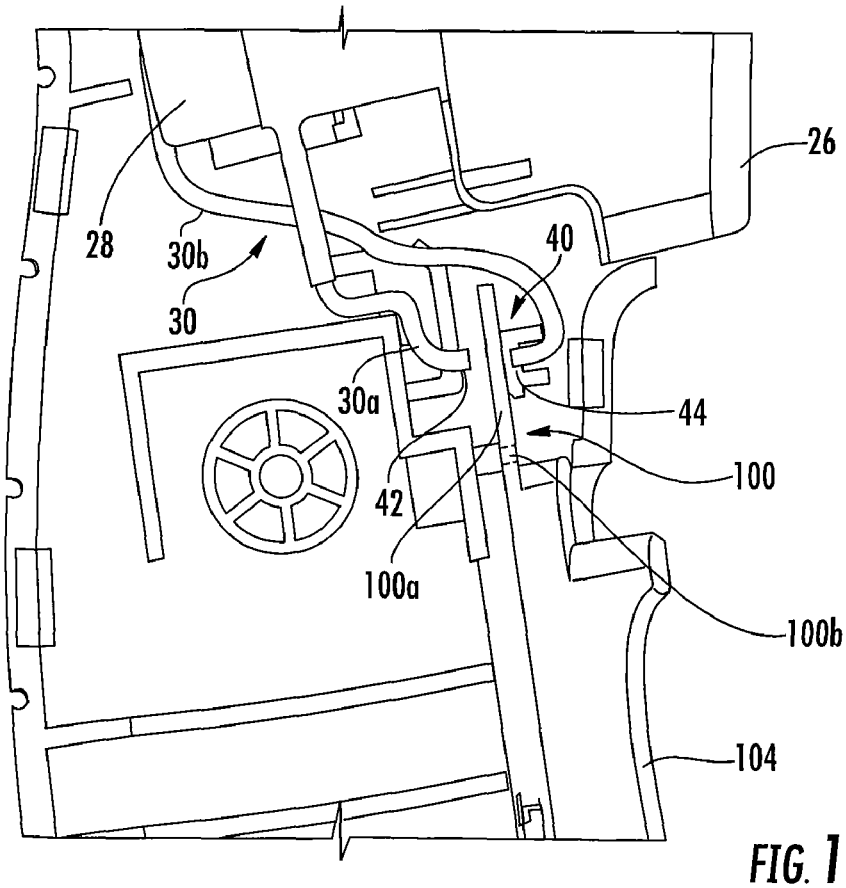
FIG. 10 is a view of the internal structure of the embodiment of the torch of FIG. 9 showing the safety mechanism in greater detail.
Figure 11:
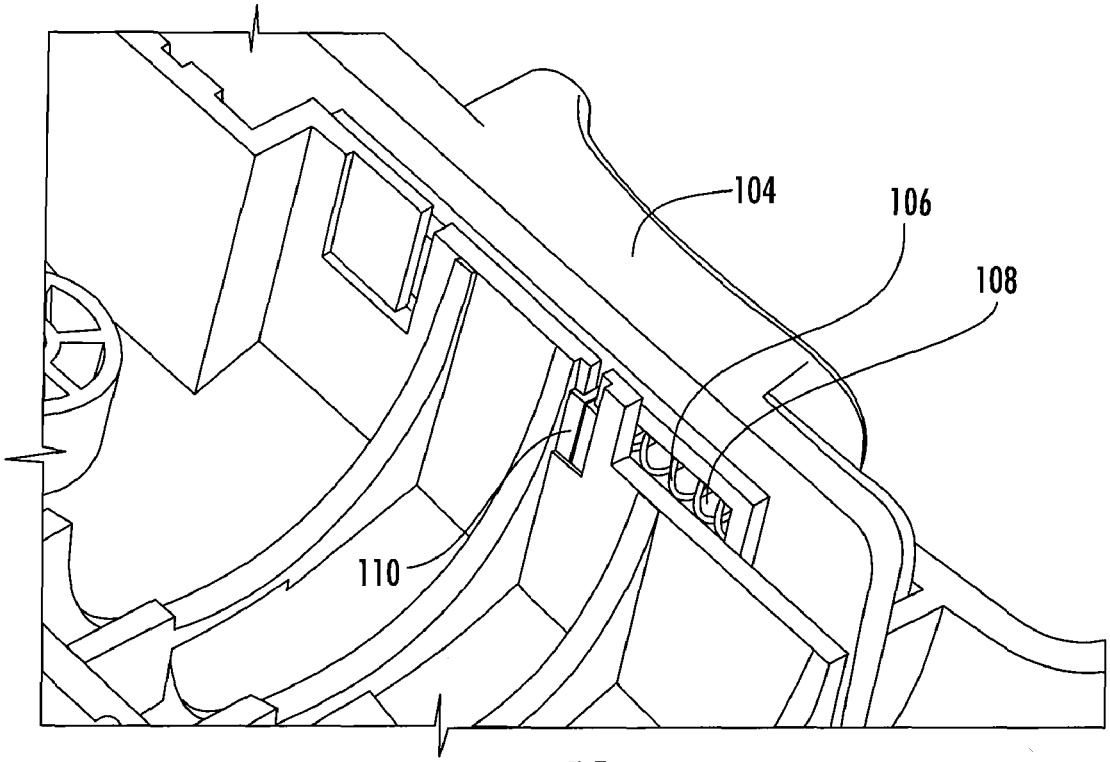
FIG. 11 is a partial perspective view of the internal structure of the embodiment of the torch of FIG. 9 showing the safety mechanism in greater detail.

Referring to the embodiment shown in FIGS. 9, 10 and 11, like numerals are used to reference like components previously described with reference to FIGS. 2 and 3. The insulator 100 consists of an electrically non-conductive member 100*a* that extends between the termini 42 and 44 to prevent arcing therebetween. In a torch that uses an igniter that generates 15,000 volts, the insulator may comprise a non-conductive pad that is approximately 7/1000 of an inch thick and approximately ¾ of an inch long and ⅝ of an inch wide. A pad of such dimensions prevents arcing from occurring either through or around the pad and electrically isolates the termini 42 and 44 from one another. Other dimensions for the insulator may also be used as dictated by the specific design of the system provided that the insulator prevents arcing in the safety position but allows arcing in the on position.

To allow arcing to occur for ignition, insulator 100 defines a through hole 100*b* that can be brought into proximity with the termini 42 and 44 such that arcing can occur between the termini through the hole 100*b*. To move the insulator 100 and allow selective arcing to occur, the insulator 100 is fixed to a switch such as slide button 104 located on the torch body such that it is accessible by the user when holding the torch. In one embodiment the slide button 104 is located on the torch body such that it can be slid upward (toward trigger 26 as shown by arrow D in FIG. 9) by a user's fingers when the user depresses the trigger 26 with fingers of the same hand. The slide button 104 may be located in other positions where either one or two handed operation is possible and may be pushed or pulled in any direction to facilitate lighting.

The slide button 104 can move relative to the torch body such that the insulator 100 occupies a first position electrically isolating the termini 42 and 44 from one another and a second position where hole 100*b* is brought into proximity with termini 42 and 44 such that arcing may occur between the termini. As best shown in FIG. 11 a compression spring 106 is located inside of a cavity 108 formed in the slide button 104. Spring 106 is positioned between the end of cavity 108 and a flange 110 mounted on the torch body. Spring 106 biases the switch 104 and insulator 100 to the insulating or "safety" position such that a solid portion of the insulator 100 is located between the termini 42 and 44 and arcing is prevented.

To light the torch the slide button 104 is moved in the direction of arrow D to align hole 100*b* of insulator 100 with the termini 42 and 44. Once button 104 is slid to this position, the trigger 26 can be depressed thereby releasing gas into the burn tube and actuating igniter 28. Current travels over conductor 30*a* until it reaches terminus 42 at which time arcing occurs between termini 42 and 44. Current then travels over conductor portion 30*b* to burn tube 17 to create an arc and ignite the fuel in the burn tube 17. The slide button 104 can be released such that spring 106 moves insulator 100 back to the insulating "safety" position. Trigger 26 can remain depressed to maintain the flame for as long as desired. While insulator 100 is shown with a hole 100*a* that allows arcing between the termini 42 and 44, the insulator may be formed with a notch, a thinned web portion, multiple holes or the like that allow an arc to pass between conductors 30*a* and 30*b*. Moreover, the insulator may be moved completely out of gap 40 such that arcing occurs around the insulator rather than through the insulator. When trigger 26 is released the flow of fuel stops due to the closing of valve 22. The torch can only be reignited by again sliding button 104 and then depressing trigger 26. If button 104 is not slid to the activating (non-insulating) position, trigger 26 can still be depressed, however, the torch will not self-ignite because no arcing occurs between termini 42 and 44 and no electrical current flows to the burn tube 17.

Figure 4:
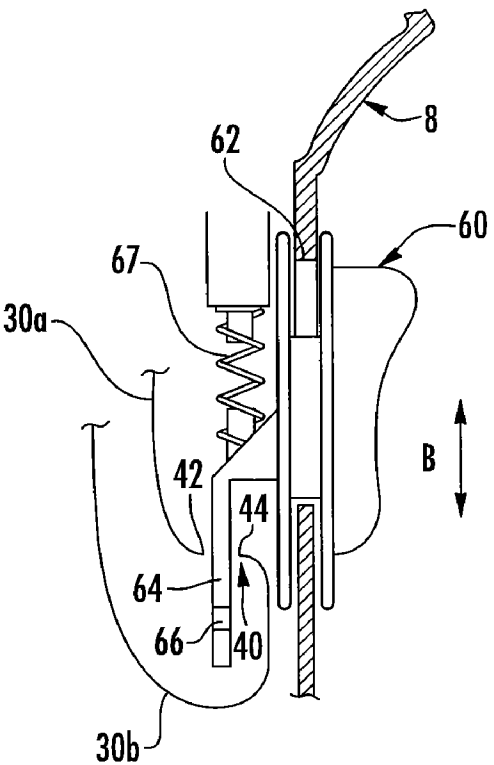

Referring to FIG. 4 a reciprocating switch 60 similar to switch 104 is used where the switch is moved into and out of the locked position along the surface of torch body 8 in the direction of arrow B. Such an arrangement is shown in FIG. 4 where like reference numerals are used to identify like components previously described with reference to the embodiment shown in FIGS. 3 and 9. Switch 60 is located in a slot 62 in torch body 8 such that it can slide along the torch body. Switch 60 carries insulator 64 where the insulator includes a through hole 66 for allowing arcing to occur between termini 42 and 44 of wires 30*a* and 30*b*. A spring 67 located inside of torch body 8 moves the switch 60 to the insulating or safety position (shown in FIG. 4).

Figure 6:
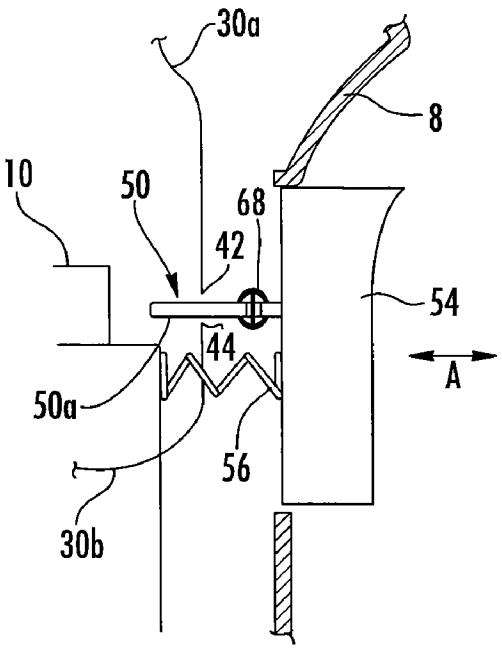
FIGS. 4, 5 and 6 are partial section views of various embodiments of the safety mechanism of the invention.

FIG. 6 illustrates another embodiment similar to that shown in FIG. 3 except that the hole 50*b* of the embodiment of FIG. 3 is replaced by an electrical conductor 68 disposed on insulator 50. The safety mechanism of FIG. 6 is shown in the insulating or safety position. Like reference numerals are used to identify like components previously described with reference to the embodiment shown in FIG. 3. When switch 54 is moved to the non-insulating or actuating position, the termini 42 and 44 contact or are closely spaced from conductor 68 such that the electrical conductor 68 carries current between terminus 42 of conductor portion 30*a* and terminus 44 of conductor portion 30*b*.

Figure 5:
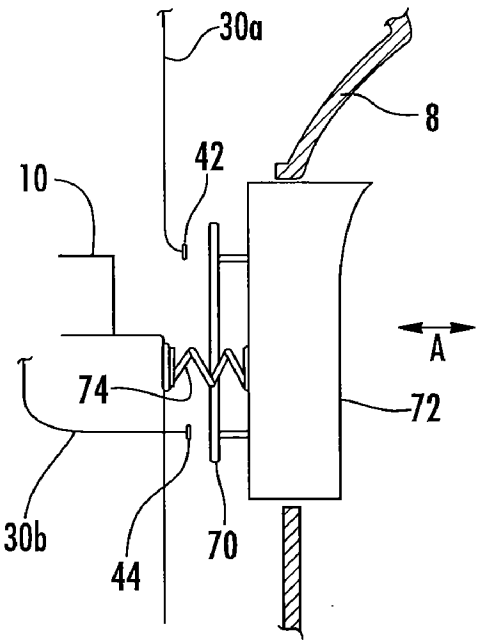

FIG. 5 illustrates another embodiment of the invention where an electrically conductive contact plate 70 is mounted to the switch 72. The safety mechanism of FIG. 5 is shown in the insulating or safety position. Like reference numerals are used to identify like components previously described with reference to the embodiment shown in FIG. 3. To ignite the torch, switch 72 is moved in the direction of arrow A to the ignition or actuating position where the termini 42 and 44 contact or are closely spaced from contact plate 70 such that the electrical contact plate carries current between conductor portion 30*a* and conductor portion 30*b*. In the safety position (shown in FIG. 5) the plate 70 is spaced a distance from the termini 42 and 44 such that no arcing occurs between terminus 42 and plate 70. A spring 74 biases the switch 72 to the insulating or safety position (shown in FIG. 5).

Figure 7:
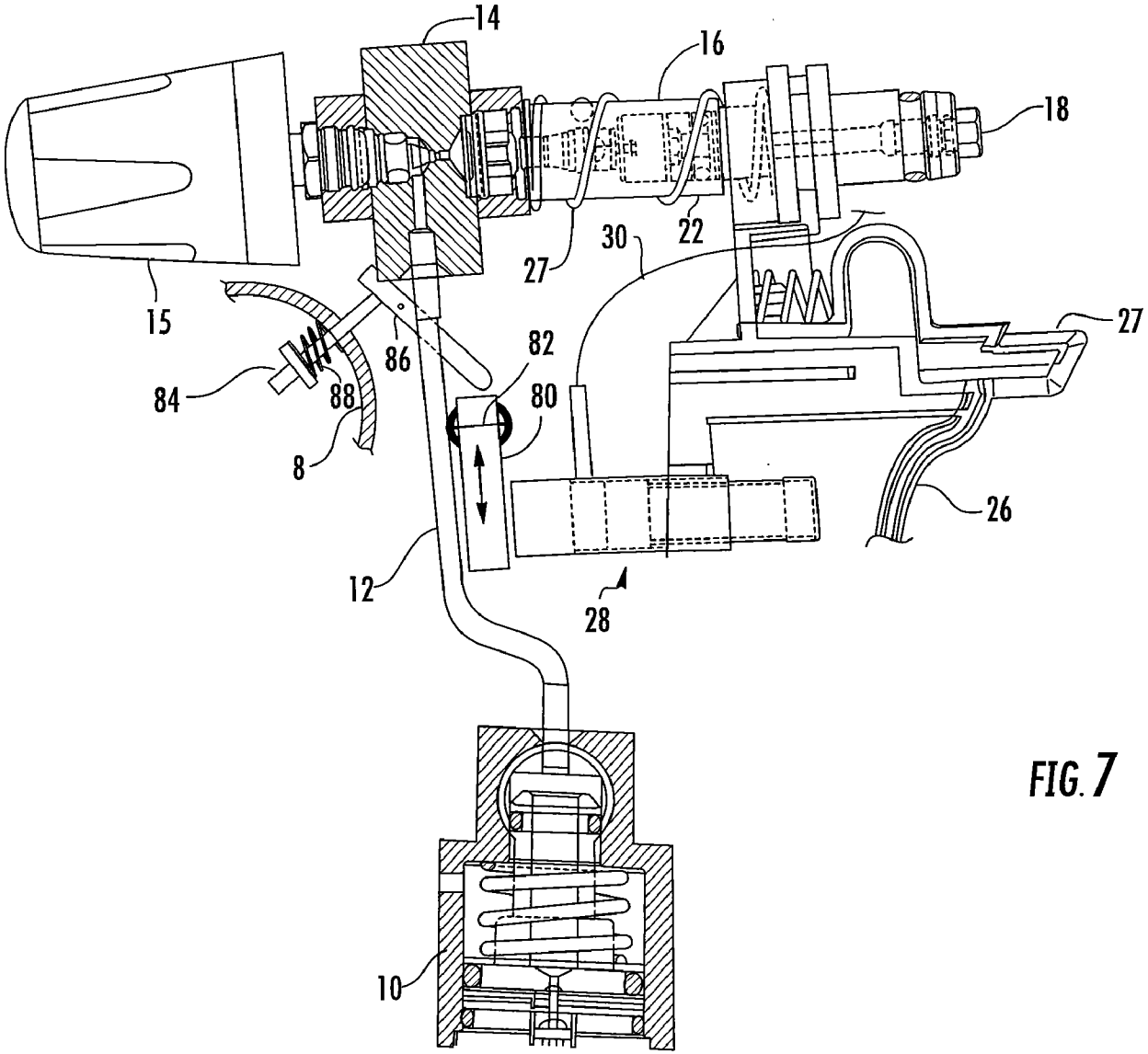
FIGS. 7 and 8 are views of the internal structure of two other embodiments of a torch of the invention.

FIG. 7 illustrates another mechanism for interrupting the current flow in the torch where like reference numerals are used to identify like components previously described with reference to FIG. 3. The igniter 28 may be in direct physical contact with the conductive fuel line 12 or close enough to allow arcing to occur in order to complete the circuit and generate the spark in the burn tube 17. In the illustrated embodiment the fuel line 12 forms a part of the ignition circuit. The fuel line may be eliminated from the circuit and a separate conductor used in its place. The safety mechanism consists of an insulator block 80 disposed between the igniter 28 and the fuel supply line 12. The insulator block 80 is made of electrically non-conductive material. A conductor 82 is located in the block 80 such that when the block is moved to the ignition or actuating position, the conductor 82 contacts, or is closely spaced from, the igniter 28 and the fuel supply line 12. When the insulator block 80 is in the illustrated insulating or safety position, the electrically conductive path between the igniter 28 and fuel supply line 12 is interrupted and no current can flow to the burn tube 17. In order to ignite the torch, a switch 84 is located on torch body 8 such that it can be actuated by a user just prior to the actuation of trigger 26. In the illustrated embodiment the switch 84 is located near the back of the torch body 8 such that it can be actuated by a user's thumb or palm while the trigger 26 is depressed by the fingers of the same hand. Switch 84 may be placed elsewhere on the torch to allow for either one hand or two hand activation. A linkage 86 may be provided between the switch 84 and the insulator block 80 to transmit the force between these elements. The switch 84 may be a push button as shown in FIG. 3 a sliding mechanism as shown in FIG. 4 or another similar mechanism. A spring 88 biases the switch 84 to bias the insulating block 80 to the insulating or safety position (shown in FIG. 7).

Figure 8:
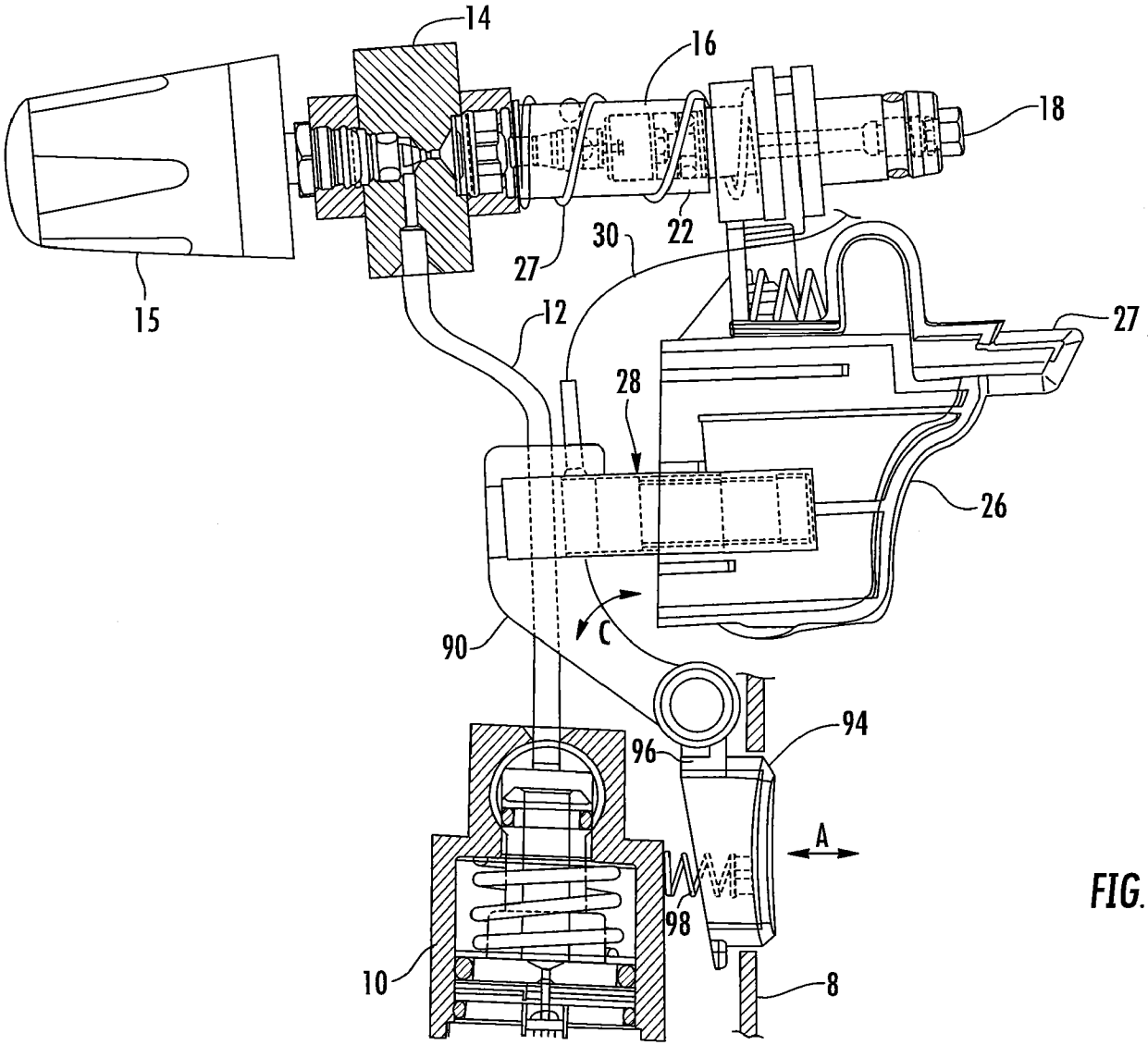

FIG. 8 illustrates another mechanism for interrupting the current flow in the torch where like reference numerals are used to identify like components previously described with reference to FIG. 3. As previously described the igniter 28 may be in physical contact with the conductive fuel line 12 or close enough to allow arcing to occur in order to complete the circuit and generate the spark in the burn tube 17. The safety mechanism consists of an insulator fan 90 disposed between the igniter 28 and the fuel supply line 12. The insulator fan 90 is made of electrically non-conductive material. When the insulator fan 90 is in the illustrated insulating or safety position, contact between the igniter 28 and fuel supply line 12 is prevented and no current can flow to the burn tube 17. In order to ignite the torch, a switch 94 is located on torch body 8 such that it can be actuated by a user simultaneously with the actuation of trigger 26. In the illustrated embodiment the switch 94 is located near the front of the torch body 8 such that it can be actuated by fingers while the trigger 26 is depressed by other fingers of the same hand. Switch 94 may be placed elsewhere on the torch to allow for either one hand or two hand activation. A linkage 96 may be provided between the switch 94 and the insulator fan 90 to translate the reciprocating motion of the switch 94 (arrow A) into rotational movement of the insulator fan 90 (arrow C) such that the fan can be rotated between a safety position where it electrically isolates the igniter 28 from supply line 12 and an ignition position where the igniter 28 and supply line 12 are in electrical communication with one another. The switch 94 may be a push button as shown in FIG. 3 a sliding mechanism as shown in FIG. 4 or another similar mechanism. A spring 98 biases the switch 94 to bias the insulating fan 90 to the insulating or safety position (shown in FIG. 8). A conductor (such as shown in FIGS. 6 and 7) may be located in the fan 90 such that when the fan is moved to the actuating position, the conductor contacts, or is closely space from, the igniter 28 and the fuel supply line 12 to complete the electrical circuit such that a spark may be generated in the burn tube when trigger 26 is depressed. It is to be understood that the embodiments shown in FIGS. 7 and 8 may be used in torches where an electrical conductor other than the fuel supply line 12, such as a wire, is used to complete the circuit where the insulator is located between the igniter 28 and the conductor.

Figure 12:
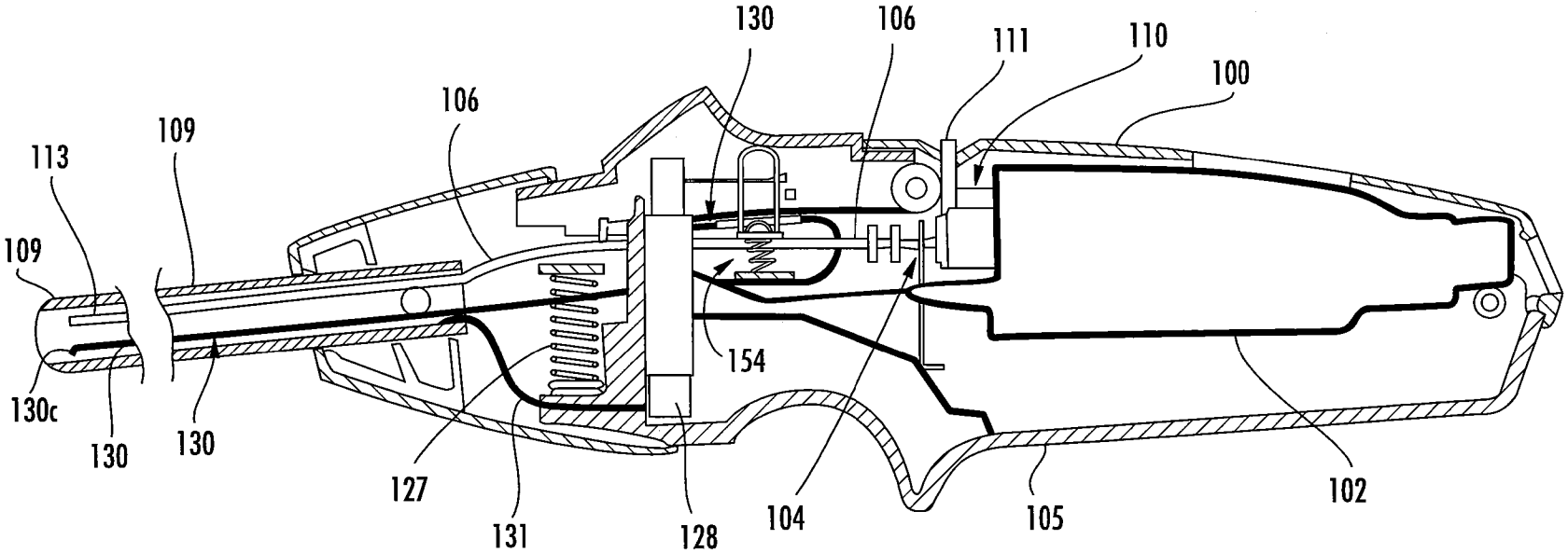
FIG. 12 is a partial section view showing another embodiment of the torch and another embodiment of the safety mechanism.
Figure 13:
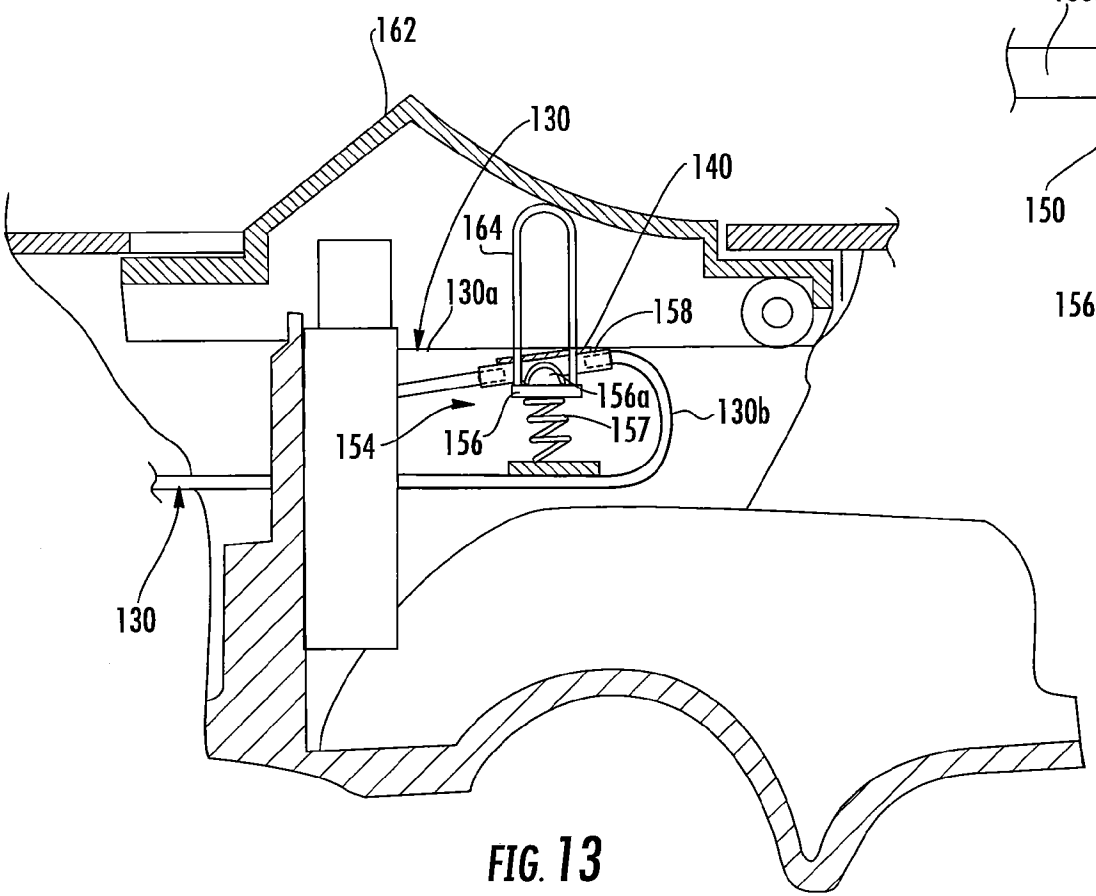
FIG. 13 is a partial section view similar to FIG. 12 showing the safety mechanism in greater detail.

Referring to FIGS. 12 and 13 another embodiment of a torch and safety mechanism is shown. The torch comprises a housing or body 100 containing a fuel supply reservoir 102 that contains fuel that will burn as a gas such as butane, propane or the like. A gas valve 104 controls the flow of fluid from reservoir 102 such that the fuel flowing from reservoir is delivered to fuel supply line 106. A manually actuated switch 105 such as pivoting trigger is used to open or close the gas valve 104 and control the flow of fuel to the burn tube 109. A spring 127 returns the trigger 105 and gas valve 104 to the closed position when the trigger is released. A second flow control device 110 may be provided that is manipulated using variable control 111 such that a user can control the size/heat of the flame generated by the torch. Fuel supply line 106 terminates in an orifice 113 in burn tube 109 such that gas exiting the orifice flows under pressure through the burn tube 109 where it is ignited.

Trigger 105 also actuates piezoelectric igniter 128 when the trigger is depressed such that a spark is created in the burn tube 109 while gas is flowing through the burn tube. To create the spark, piezoelectric igniter 128 is connected to electrical conductors 130 and 131. The electrical conductors may include any electrically conductive element such as wires, ribbons or the like. One electrical conductor 131 may be in electrically conductive contact with the burn tube 109.

Electrical conductor 130 extends into the burn tube 109. To create the spark in the burn tube 109, piezoelectric igniter 128 is actuated by depressing trigger 105. The end 130*c* of electrical conductor 130 is positioned in burn tube 109 such that it is spaced from the burn tube a distance such that arcing occurs between the end 130*c* of the conductor 130 and the interior surface of burn tube 109 to create a spark that ignites the fuel/air mixture flowing through the burn tube.

A gap 152 is created in conductor 130 by a first conductor portion 130*a* that extends from piezoelectric igniter 128 to terminus 142 and a second conductor portion 130*b* that extends from terminus 144 to the burn tube. Termini 142 and 144 are spaced to create gap 152 that is sized such that arcing can occur between the termini 142 and 144 when an air gap is present between the termini. The arcing completes a circuit between first conductor portion 130*a* and second conductor portion 130*b* such that the electrical potential created by igniter 128 is transmitted to the burn tube 109 as previously described.

A flexible sleeve 150 surrounds and is connected to termini 142 and 144 such that an air gap 152 is formed in sleeve 150 between the termini 142 and 144. Sleeve 150 is made of a flexible electrically non-conductive material such as rubber or plastic. The air gap 152 is dimensioned such that arcing may occur between termini 142 and 144 when the device is in the position shown in FIG. 14.

Figure 14:
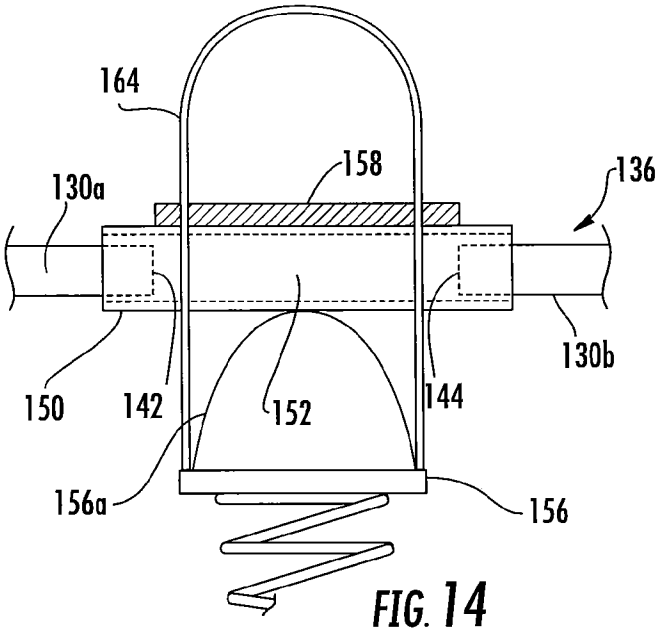
FIG. 14 is a view showing the safety mechanism in an actuating position.

To prevent arcing from occurring between the termini 142 and 144 a plunger assembly 154 is moved into engagement with the sleeve 150 to close the air gap 152 as shown in FIG. 13. The plunger assembly 154 is biased by spring 157 so as to normally assume the insulating position of FIG. 13 where arcing between the termini 142 and 144 is prevented. As shown in FIGS. 13 and 14 plunger assembly 154 includes a plunger 156 having a head 156*a* that presses sleeve 150 against a stationary support 158 located in the housing to close the gap 152 by forcing the opposite sides of sleeve 150 against one another. The plunger 156 is normally biased to the safety position shown in FIG. 13 by spring 157 such that arcing is prevented. To allow ignition the plunger is moved against spring 157 using a manually actuated switch 162 located on the housing to the position of FIG. 14. Switch 162 may include a push button, sliding button, pull tab or the like. Switch 162 contacts a transmission member 164 such as a rigid finger such that depression of switch 162 moves plunger 156 out of engagement with the sleeve 150 to open a path for a spark to cross gap 152 and allow ignition to occur.

Figure 15:
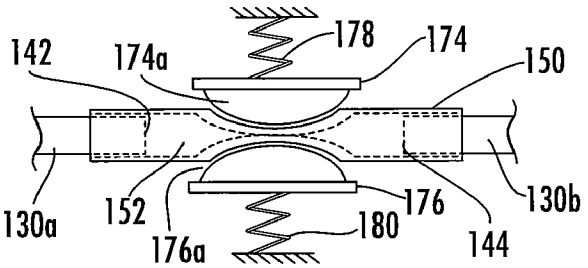
FIGS. 15 through 20 show alternate embodiments of the safety mechanism.

As best shown in FIG. 15 another embodiment of the plunger assembly is shown comprising a first plunger 174 having a head 174*a* and a second plunger 176 having a head 176*a* that press on opposite sides of sleeve 150 to close the gap 152 by forcing the opposed sides of sleeve 150 into contact with one another. The plungers 174 and 176 are normally biased to the safety position shown in FIG. 15 by springs 178 and 180, respectively, such that arcing is prevented between termini 142 and 144 of electrical conductor portions 130*a* and 130*b*. To allow ignition, the plungers 174 and 176 are moved against springs 178 and 180, respectively, using a manually actuated switch located on the housing. The switch may include a push button, sliding button, pull tab or the like. Moreover, separate switches may be used, one associated with plunger 174 and one associated with plunger 176.

Figure 16:
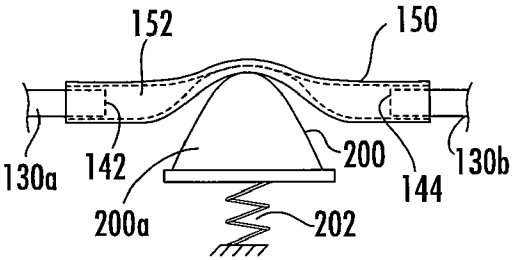

Referring to FIG. 16 another embodiment of the plunger assembly is shown including a plunger 200 having a head 200*a* that presses sleeve 150 to force the opposed sides of sleeve 150 against one another. In the embodiment of FIG. 16 the side of sleeve opposite plunger 200 is not supported against a second plunger or a stationary support such that the force exerted by plunger 200 is unopposed except by the resiliency of sleeve 150. The sleeve 150 will deform such that the gap is securely closed and no arcing can occur between termini 142 and 144 of electrical conductor portions 130*a* and 130*b*. The plunger 200 is normally biased to the safety position shown in FIG. 16 by spring 202 such that arcing is prevented. To allow ignition the plunger 200 is moved against spring 202 using a manually actuated switch located on the housing. The switch may include a push button, sliding button, pull tab or the like.

Figure 17:
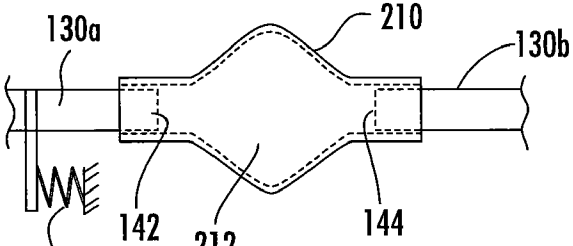
Figure 18:
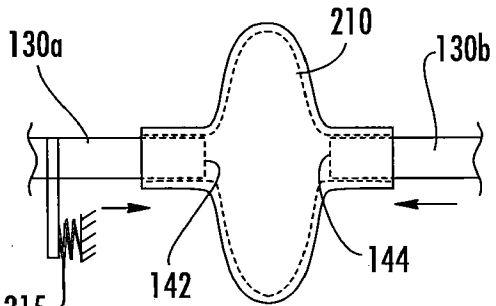

Referring to FIGS. 17 and 18 another embodiment of the safety mechanism of the invention is shown where a flexible sleeve 210 surrounds and is connected to termini 142 and 144 such that an air gap 212 is formed in sleeve 210 between the termini 142 and 144. Sleeve 210 is made of a flexible electrically non-conductive material such as rubber or plastic. The air gap 212 is dimensioned such that no arcing may occur between termini 142 and 144 when the device is in the position shown in FIG. 17. To close the circuit and allow arcing to occur one or both of termini 142 and 144 are moved toward the opposite termini such that the gap between the termini is shortened as shown in FIG. 18. The termini are moved toward one another such that the distance between the termini allows arcing to occur between the termini. In the illustrated embodiment one or both of termini 142 and 144 are connected to an actuator switch such as a slide button where the user can manipulate slide button to move terminus 142 closer to terminus 144. Where the conductor is, for example a wire, enough "play" is provided in the conductor portion 130*a* to allow the end of the conductor portion to be moved toward and away from the opposite conductor portion 130*b*. The conductor portions may be normally biased to the non-conductive position of FIG. 17 by a spring 215 that engages the switch or one or both of conductors 130*a* and/or 130*b*. Alternatively, the sleeve 210 could be formed to act as a spring where the sleeve is formed in a predetermined shape where the resiliency of the material returns the spring to the preformed shape when the actuator switch is released.

Figure 19:
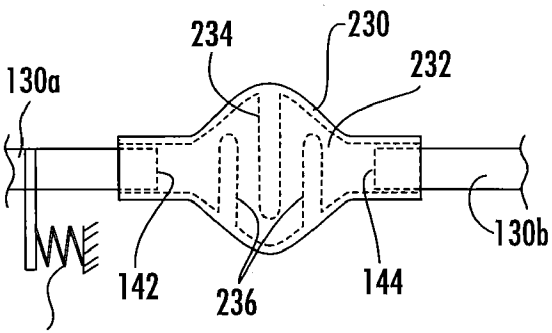
Figure 20:
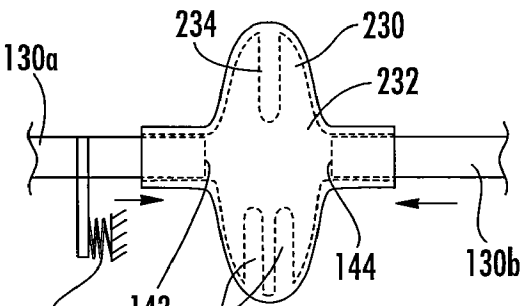

Referring to FIGS. 19 and 20 another embodiment of the safety mechanism of the invention is shown where a flexible sleeve 230 surrounds and is connected to termini 142 and 144 such that an air gap 232 is formed in sleeve 230 between the termini 142 and 144. Sleeve 230 is made of a flexible electrically non-conductive material such as rubber or plastic and is formed with internal interengaging elements 234 and 236 that are dimensioned to close the air gap 232 such that no arcing may occur between termini 142 and 144 when the device is in the position shown in FIG. 19. To close the circuit and allow arcing to occur one or both of termini 142 and 144 are moved toward the opposite termini such that the sleeve is deformed to separate elements 234 and 236 and shorten the air gap between the termini. The termini 142 and 144 are moved toward one another such that the distance between the termini allows arcing to occur between the termini over the unobstructed air gap. In the illustrated embodiment one or both of termini 142 and 144 are connected to an actuator switch such as slide button where the user can manipulate slide button to move the end of conductor 130*a* closer to conductor 130*b*. Where the conductor is, for example a wire, enough "play" is provided in the wire to allow the end of the wire to be moved toward and away from the opposite conductor. The electrical conductor may be normally biased to the non-conductive position of FIG. 19 by a spring 242 that engages the switch or one or both of conductors 130*a* and 130*b*. Alternatively, the sleeve 230 could be formed to act as a spring where the sleeve is formed in a predetermined shape where the resiliency of the material returns the spring to the preformed shape when the actuator switch is released.

While embodiments of the invention are disclosed herein, various changes and modifications can be made without departing from the spirit and scope of the invention. One of ordinary skill in the art will recognize that the invention has other applications in other environments. Many embodiments are possible. The following claims are in no way intended to limit the scope of the invention to the specific embodiments described above.

The invention claimed is:

1. A safety for a torch comprising:

means for creating an electrical potential;

an electrically conductive element comprises a fuel line for transmitting the electrical current from the means for creating an electrical potential to a burn tube to create a spark for igniting fuel in the burn tube and an air gap in the electrically conductive element that allows an arc to occur across the gap;

an electrically non-conductive member movable between a first position where the electrically non-conductive member prevents the arc from occurring and interrupts the flow of electrical current in the electrically conductive element and a second position where the arc is allowed to occur across the gap; and wherein said electrically non-conductive member includes a hole; said hole allows arcing to occur across the air gap.

2. The safety for a torch of claim 1 wherein the electrically conductive element comprises a wire.

3. The safety for a torch of claim 1 wherein the electrically conductive element defines a first electrical conductor and a second electrical conductor.

4. The safety for a torch of claim 3 wherein said first electrical conductor comprises a first terminus and said second electrical conductor comprises a second terminus, said first terminus and said second terminus being arranged opposite one another across said air gap.

5. The safety for a torch of claim 3 wherein said electrically non-conductive member comprises an electrically conductive portion for conducting electricity between said first electrical conductor and said second electrical conductor.

6. The safety for a torch of claim 1 wherein the electrically non-conductive member is biased to the first position.

7. The safety for a torch of claim 1 wherein the means for creating an electrical potential is a piezoelectric igniter.

* * * * *